US009968228B2

(12) United States Patent
Sellars et al.

(10) Patent No.: US 9,968,228 B2
(45) Date of Patent: May 15, 2018

(54) TOWEL DISPENSING SYSTEM INCLUDING A BRACKET AND WATER-RESISTANT CONTAINER WITH A HANDLE

(71) Applicant: SELLARS ABSORBENT MATERIALS, INC, Milwaukee, WI (US)

(72) Inventors: Ryan Sellars, Mukwonago, WI (US); Daniel Alan Klein, Madison, WI (US); Thomas T. Ziegert, Franklin, WI (US)

(73) Assignee: SELLARS ABSORBENT MATERIALS, INC., Milwaukee, WI (US)

( * ) Notice: Subject to any disclaimer, the term of this patent is extended or adjusted under 35 U.S.C. 154(b) by 276 days.

(21) Appl. No.: 14/754,157

(22) Filed: Jun. 29, 2015

(65) Prior Publication Data

US 2016/0000275 A1 Jan. 7, 2016

Related U.S. Application Data

(60) Provisional application No. 62/020,267, filed on Jul. 2, 2014.

(51) Int. Cl.

| | |
|---|---|
| ***A47K 10/22*** | (2006.01) |
| ***A47K 10/36*** | (2006.01) |
| ***A47K 10/38*** | (2006.01) |
| *A47K 10/32* | (2006.01) |

(52) U.S. Cl.

CPC ..... *A47K 10/38* (2013.01); *A47K 10/3818* (2013.01); *A47K 2010/3233* (2013.01)

(58) Field of Classification Search

CPC ..... A47K 10/38; A47K 10/3818; A47K 2010/3233; A47K 10/185

See application file for complete search history.

(56) References Cited

U.S. PATENT DOCUMENTS

| | | | | |
|---|---|---|---|---|
| D322,215 | S * | 12/1991 | Hunt | D9/733 |
| D322,932 | S * | 1/1992 | Hunt | D9/733 |
| 5,228,632 | A | 7/1993 | Addison et al. | |
| 5,803,249 | A | 9/1998 | Harsanyi, Jr. et al. | |
| 7,578,414 | B2 * | 8/2009 | Sellars | A47K 10/3818 220/781 |

(Continued)

FOREIGN PATENT DOCUMENTS

| | | |
|---|---|---|
| CN | 2118485 | 10/1992 |
| EP | 2583602 A1 | 4/2013 |

(Continued)

OTHER PUBLICATIONS

International Search Report and Written Opinion for Application No. PCT/US2015/038347 dated Sep. 25, 2015 (14 pages).

(Continued)

*Primary Examiner* — William A. Rivera

(74) *Attorney, Agent, or Firm* — Michael Best & Friedrich LLP

(57) ABSTRACT

Systems and methods for dispensing towels. In one embodiment, the system includes a container configured to receive a roll of towels, and a bracket configured to mount to a support surface. The bracket engages the container to alternately suspend the container from the support surface in a first orientation and in a second orientation that is different than the first orientation.

19 Claims, 8 Drawing Sheets

(56) References Cited

U.S. PATENT DOCUMENTS

| | | | | |
|---|---|---|---|---|
| 7,992,745 | B2 | 8/2011 | Sellars et al. | |
| 2003/0116582 | A1 | 6/2003 | Tosdale | |
| 2005/0189455 | A1* | 9/2005 | Formon | A47K 10/185 248/200 |
| 2010/0117495 | A1 | 5/2010 | Cornell | |
| 2013/0126665 | A1* | 5/2013 | Fournier | A47K 10/40 242/598.6 |
| 2014/0291439 | A1* | 10/2014 | Winestock | A47K 10/3827 242/588.3 |
| 2015/0053812 | A1* | 2/2015 | Bredahl | A47K 10/3818 242/588.3 |

FOREIGN PATENT DOCUMENTS

| | | | |
|---|---|---|---|
| KR | 2019920006774 | | 9/1992 |
| WO | 2014040132 | | 9/1998 |
| WO | 2008085090 | A1 | 7/2008 |

OTHER PUBLICATIONS

Extended European Search Report from the European Patent Office for Application No. 15814919.5 dated Jan. 30, 2018 (11 pages).

* cited by examiner

TOWEL DISPENSING SYSTEM INCLUDING A BRACKET AND WATER-RESISTANT CONTAINER WITH A HANDLE

CROSS-REFERENCE TO RELATED APPLICATIONS

This application claims priority to U.S. Provisional Patent Application No. 62/020,267, filed Jul. 2, 2014, the entire contents of which are incorporated by reference herein.

FIELD OF THE INVENTION

The present invention relates to containers for storing and dispensing towels, for example absorbent, disposable towels.

SUMMARY

In one embodiment, the invention provides a system for dispensing towels. The system includes a container configured to receive a roll of towels. The system also includes a bracket configured to mount to a support surface. The bracket engages the container to alternately suspend the container from the support surface in a first orientation and in a second orientation that is different than the first orientation.

In another embodiment, the invention provides a system for dispensing towels. The system includes a container having a body configured to receive a roll of towels. The body includes an open end and a closed end. The container also has a handle projecting outwardly from the container. The handle is configured to be grasped by a user. The container further includes a lid connected to the open end of the body. The lid has an opening through which the roll of towels is dispensed. The system also includes a bracket configured to mount to a support surface. The bracket engages the container to suspend from the container from the support surface in an orientation in which the opening of the lid generally faces toward the ground.

In yet another embodiment, the invention provides a method of dispensing towels from a container. The method includes mounting a bracket to a support surface, engaging the container with the bracket so that the bracket suspends the container from the support surface in a first orientation, and dispensing the towels from the container while the container is suspended from the support surface by the bracket in the first orientation. The method also includes engaging the container with the bracket so that the bracket suspends the container from the support surface in a second orientation that is different than the first orientation, and dispensing the towels from the container while the container is suspended from the support surface by the bracket in the second orientation.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
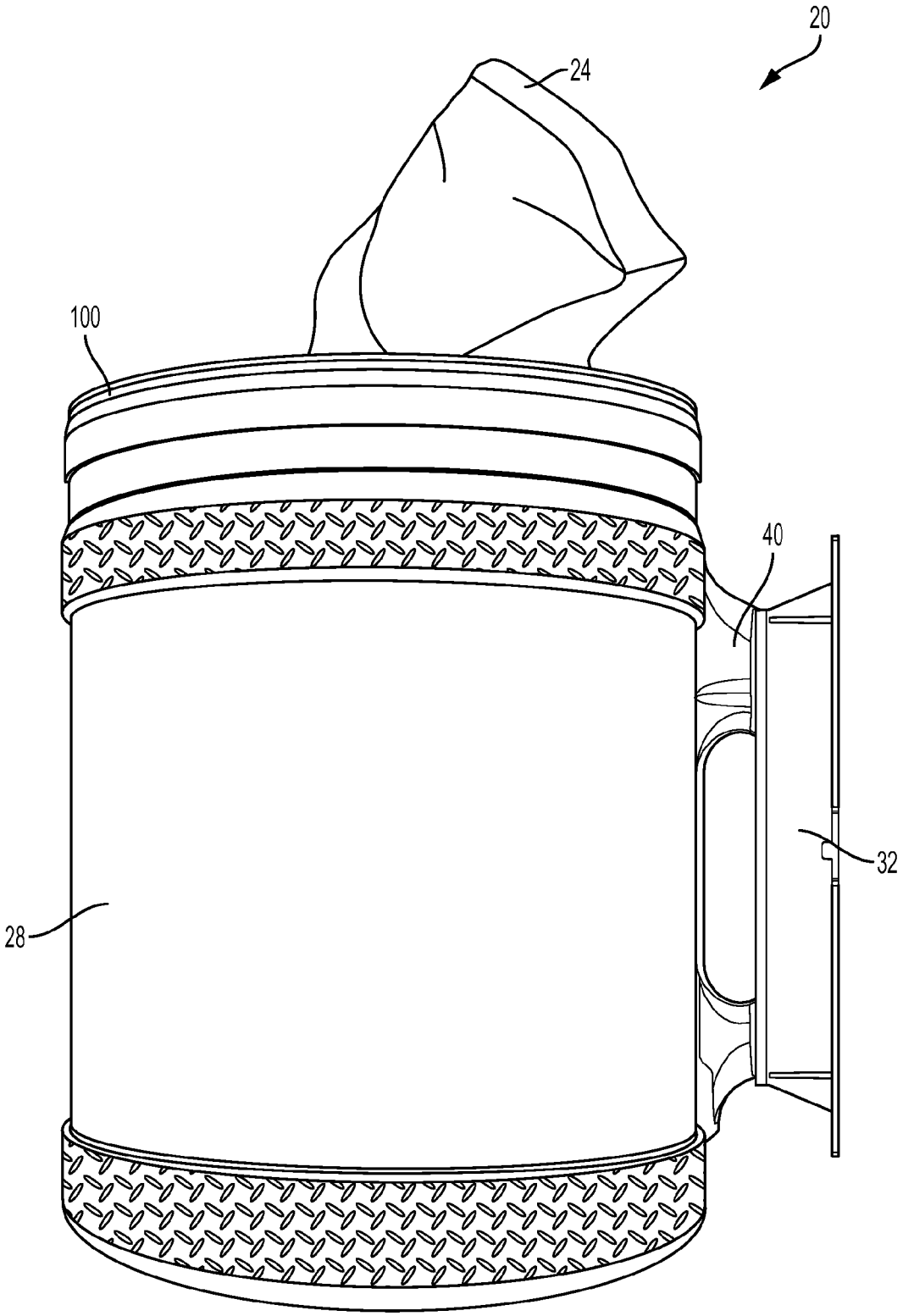
FIG. 1 is a perspective view of a dispensing system including a container and a bracket.
Figure 2:
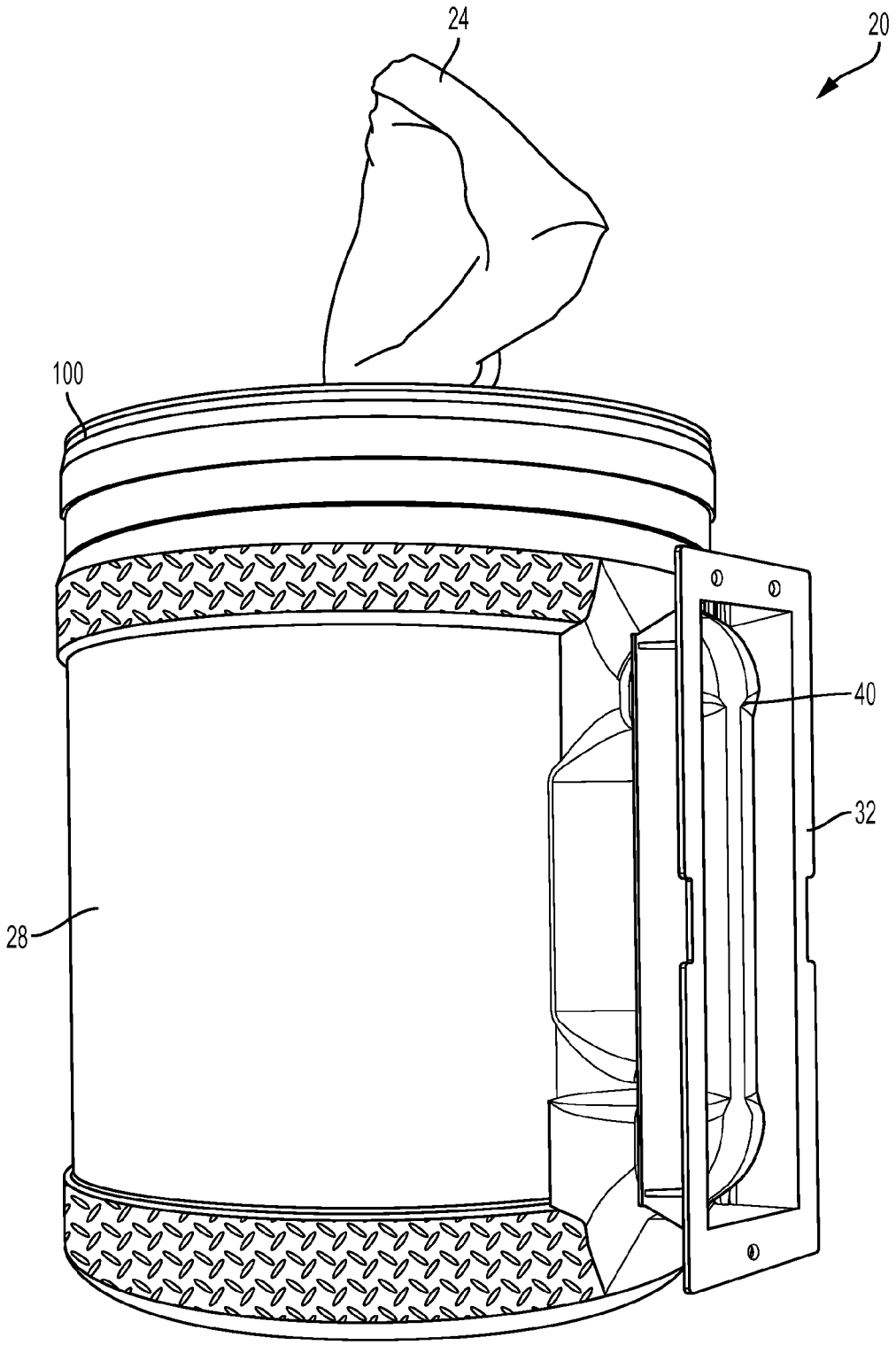
FIG. 2 is another perspective view of the dispensing system.

FIGS. 1 and 2 illustrate a dispensing system 20 for dispensing towels 24 and similar items such as absorbent, disposable towels, including towels manufactured from a non-woven web of fibers. The towels 24 may be dry towels or wet towels. Additionally or alternatively, the towels 24 may be reusable towels. The illustrated dispensing system 20 includes a container 28 and a bracket 32. The container 28 is configured to receive and store a roll of disposable towels 24 in a manner similar to the dispenser disclosed in U.S. Pat. No. 7,992,745, the entire contents of which are incorporated by reference herein. The bracket 32 engages the container 28 to suspend the container 32, and thereby the disposable towels 24, from a support surface (e.g., a wall).

FIGS. 3-6 illustrate the container 28 of the dispensing system 20 in more detail. The illustrated container 28, or bucket, includes a generally cylindrical body 36 and a handle 40. In the illustrated embodiment, the body 36 and the handle 40 are integrally formed by, for example, blow molding such that the container 28 is a unitary structure. In other embodiments, the container 28 may be formed by other methods and/or of other materials. In still other embodiments, the body 36 and the handle 40 may be separate pieces that are permanently or releasably coupled together. In some embodiments, the container 28 may have a height H of about 10 inches and a diameter D of about 9 inches. Such dimensions are suitable for receiving and storing an appropriate supply of the disposable towels 24. In other embodiments, the container 28 may be relatively larger or smaller, depending on the type and amount of disposable towels to be stored.

Figure 4:
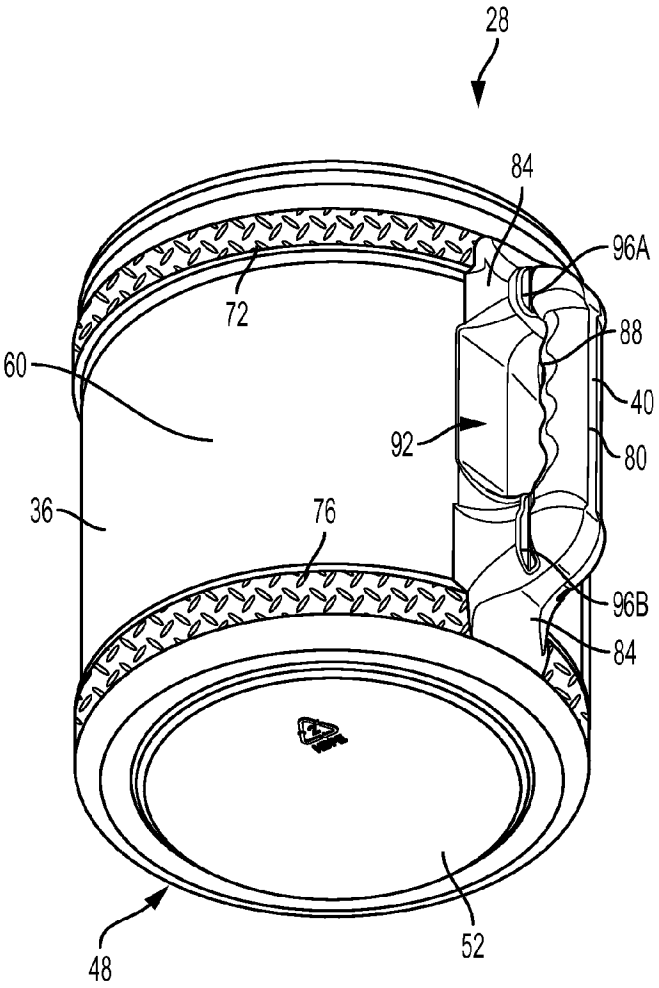
FIG. 4 is a bottom perspective view of the container.
Figure 3:
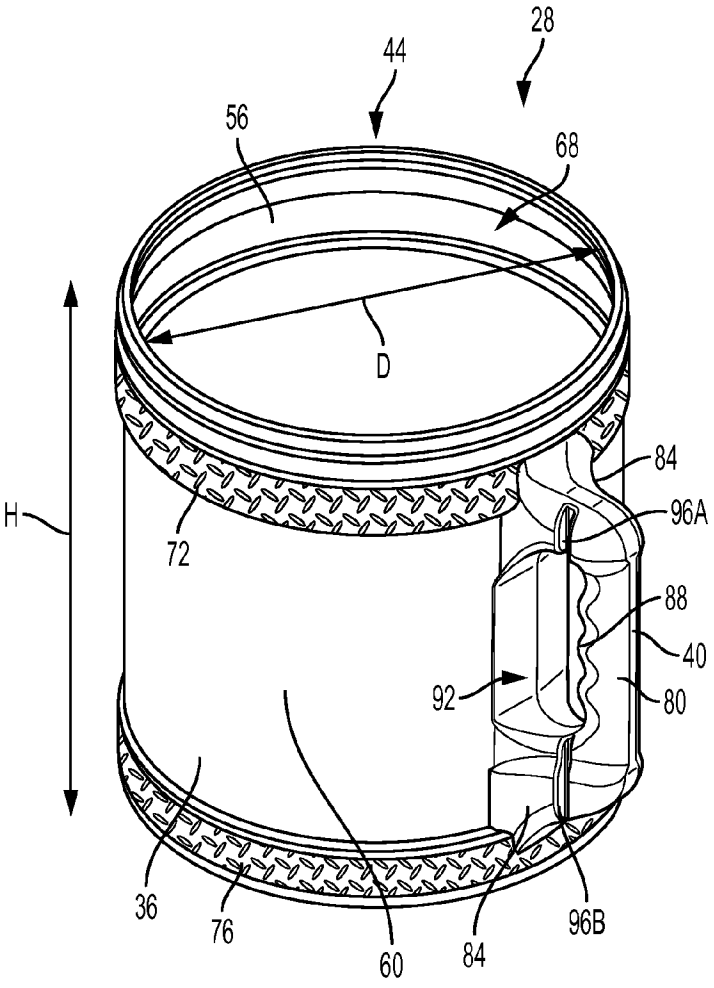
FIG. 3 is a top perspective view of the container of the dispensing system.

The cylindrical body 36 includes an open end 44 (FIG. 3) and a closed end 48 (FIG. 4). The closed end 48 is formed by a bottom 52 of the body 36. The body 36 also includes an inner surface 56, an outer surface 60, and a central longitudinal axis 64 extending through the open and closed ends 44, 48 of the body 36. The inner surface 56 defines a chamber 68 configured (e.g., shaped and sized) to receive the roll of disposable towels 24 (FIG. 1). The outer surface 60 is generally smooth and continuous, but also includes two raised rings or strips of textured surfaces 72 and 76. The strips 72 and 76 are raised outwardly from the remainder of the body 36. The first strip 72 is formed adjacent the open end 44 of the body 36. The second strip 76 is formed adjacent the closed end 48 of the body. The strips 72 and 76 are also texturized to facilitate handling the container 28 and to give the container 28 a more rugged appearance.

Figure 5:
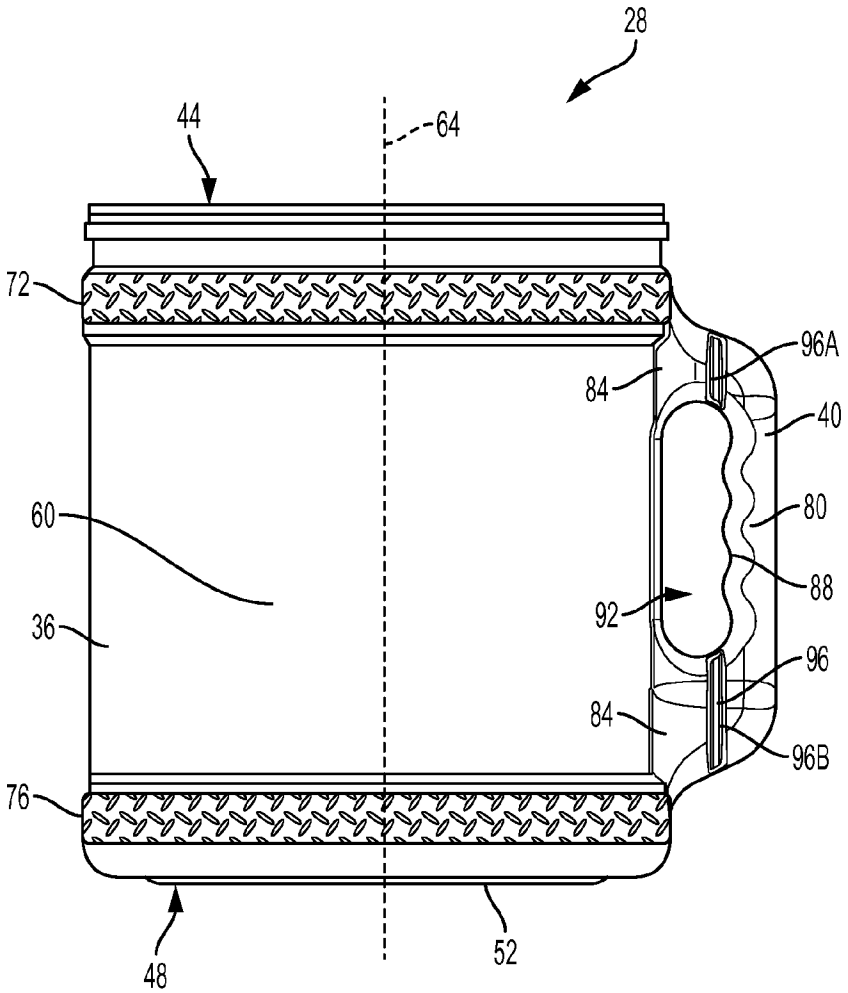
FIG. 5 is a side view of the container.

As shown in FIG. 5, the handle 40 projects outwardly from the cylindrical body 36. The handle 40 is configured to be grasped by a user to facilitate lifting and carrying the container 28. In particular, the handle 40 is designed to be fit in and be grasped by a human hand. The illustrated handle 40 includes a grip 80 and two bosses 84. The grip 80 is the portion of the handle 40 that is actually grasped by the user while carrying the container 28. In the illustrated embodiment, the grip 80 includes a contoured surface 88 having ridges that generally match the fingers of the user. The grip 80 extends in a direction generally parallel to the central longitudinal axis 64 of the body 36. The bosses 84 extend between the grip 80 and the body 36 to connect the grip 80 to the body 36. The bosses 84 space the grip 80 apart from the body 36 so that an opening 92 is defined between the grip 80 and the outer surface 60 of the body 36. The opening 92 allows the user to extend a portion of his or her hand through the opening 92 and around the grip 80.

Figure 6:
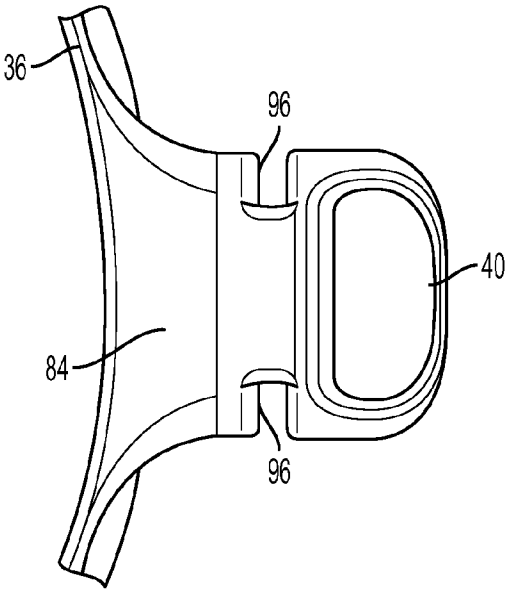
FIG. 6 is an enlarged top view of a handle of the container.

The illustrated handle 40 also defines slots 96. As shown in FIG. 6, the slots 96 are formed in opposing sides of the handle 40 and extend in a direction that is generally parallel to the central longitudinal axis 64 of the body 36. In the illustrated embodiment, the slots 96 are formed in the bosses 84 of the handle 40, but may alternatively be formed in the grip 80. Due to the configuration of the handle 40, each slot 96 is divided into two discrete slot sections 96A and 96B by the opening 92. The corresponding slot sections 96A and 96B are generally aligned (i.e., the corresponding slot sections 96A and 96B extend along a straight line or axis). The slots 96 are configured to receive a portion of the bracket 32, as further discussed below, to connect the container 28 to the bracket 32.

Figure 7:
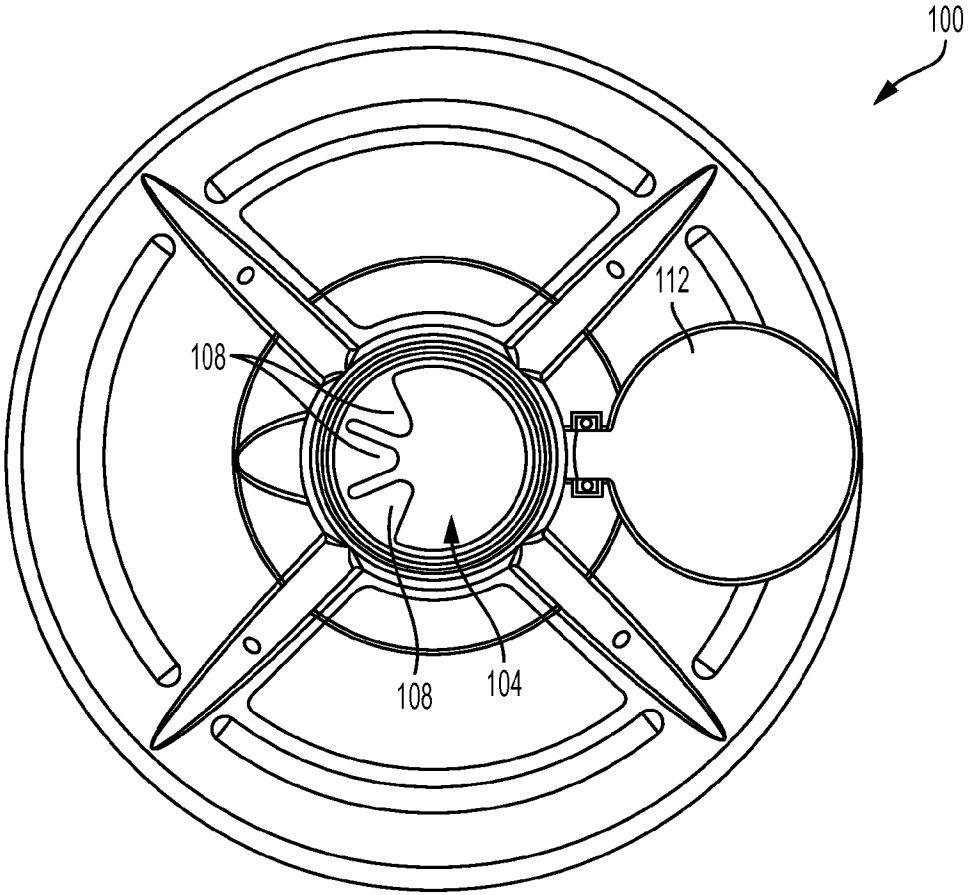
FIG. 7 is a top view of a lid of the container.

As shown in FIG. 7, the container 28 also includes a lid 100. The lid 100 is configured to fit on the open end 44 of the cylindrical body 36 to at least partially enclose the chamber 68. The lid 100 defines an opening 104 through which the disposable towels 24 (FIG. 1) can be dispensed. In the illustrated embodiment, the lid 100 also includes a plurality of teeth 108 and a cover 112. The teeth 108 extend into the opening 104 and selectively engage the towels 24 as the towels 24 are being dispensed. In particular, the roll of disposable towels 24 stored within the container 28 is made up of a plurality of sheets connected together by perforations. The teeth 108 releasably snag portions of the towels 24 so that individual sheets separate from the remainder of the roll along the perforations as the towels 24 are pulled out of the container 28 through the opening 104. The illustrated teeth 108 are generally triangular, cantilevered projections that decrease in width toward the center of the opening 104. In the illustrated embodiment, the lid 100 includes three teeth 108. In other embodiments, the lid 100 may include fewer or more teeth 108.

The cover 112 is pivotally attached to the lid 100 adjacent the opening 104. The cover 112 is movable between an open position (FIG. 7), in which the opening 104 is uncovered so the towels 24 can be accessed and dispensed from the chamber 68, and a closed position, in which the opening 104 is closed to inhibit access to the towels 24 inside the chamber 68. The cover 112 may be closed during, for example, transit to help inhibit dirt and other debris from entering the container 28. Additionally or alternatively, if the disposable towels 24 are treated with a liquid, the cover 112 may be closed to help keep the towels 24 from drying out.

Figure 10:
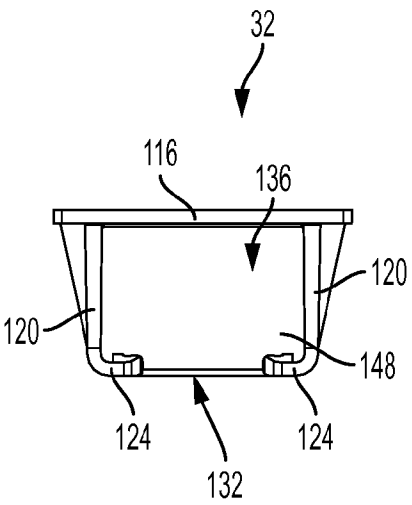
FIG. 10 is an end view of the bracket.
Figure 9:
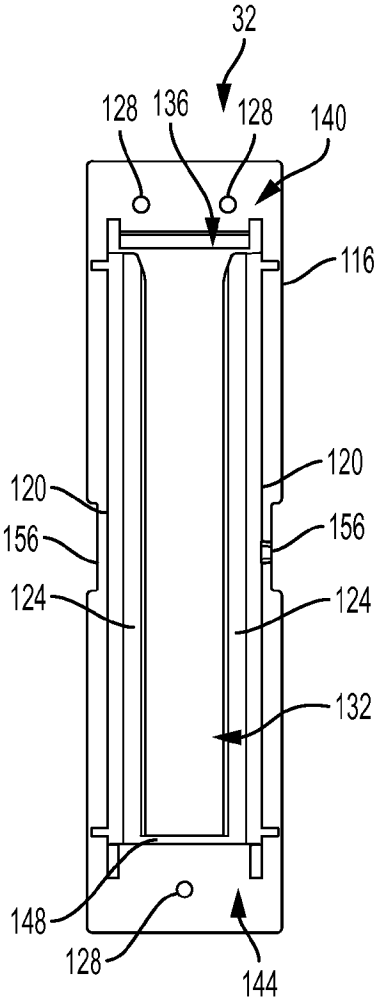
FIG. 9 is a front view of the bracket.
Figure 8:
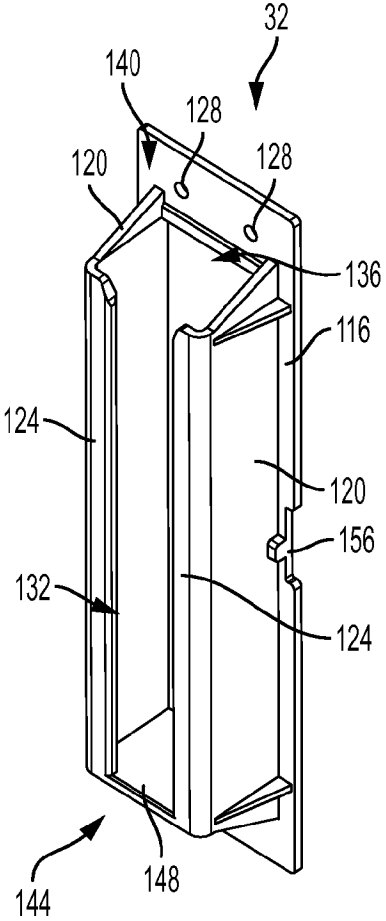
FIG. 8 is a perspective view of the bracket of the dispensing system.

FIGS. 8-10 illustrate the bracket 32 of the dispensing system 20 in more detail. The illustrated bracket 32 includes a baseplate 116, a pair of opposing sidewalls 120, and two rails 124. The baseplate 116 is a generally planar member. The baseplate 116 is configured to mount to a support surface, such as a wall. In the illustrated embodiment, the baseplate 116 includes apertures 128. The apertures 128 receive fasteners (e.g., nails, screws, etc.) to secure the bracket 32 to the support surface. In other embodiments, the bracket 32 may be secured to the support surface using other suitable fastening means (e.g., adhesives, magnets, hooks, clips, posts, etc.).

The sidewalls 120 are spaced apart from each other and extend perpendicularly from the baseplate 116. The rails 124 are formed on free ends of the sidewalls 120 (i.e., the ends of the sidewalls 120 opposite from the baseplate 116) and extend toward each other. The rails 124 are spaced apart from each other such that a gap 132 exists between the rails 124. Together, the baseplate 116, the sidewalls 120, and the rails 124 define a channel 136 that is configured (e.g., shaped and sized) to receive a portion of the container 28. In the illustrated embodiment, the channel 136 receives the grip 80 of the handle 40. In other embodiments, the channel 136 may receive other portions of the handle 40 and/or of the container 28.

The illustrated channel 136 includes an open end 140 and a closed end 144. The closed end 144 is formed by a bottom wall 148 of the bracket 32 that extends between the two sidewalls 120. To connect the container 28 to the bracket 32, the handle 40 is slid into the channel 136 through the open end 140. As the handle 40 slides into the channel 136, the slots 96 in the handle 40 receive the rails 124 of the bracket 32. The slots 96 and the rails 124 help properly guide the handle 40 into the chamber 68. In addition, the rails 124 inhibit the container 28 from separating from the bracket 32 (e.g., moving away from the baseplate 116 in a direction perpendicular to a plane defined by the baseplate 116). The handle 40 is fully inserted into the channel 136 when the handle 40 contacts the bottom wall 148 of the bracket 32. In other embodiments, the slots 96 may be formed in the bracket 32, and the rails 124 may be part of the handle 40.

When the container 28 is connected to the bracket 32, the bracket 32 is used to hold and support the container 28. For example, the bracket 32 can be mounted to a support surface (e.g., a wall) to suspend the container 28 from the support surface. A user can then remove the disposable towels 24 (FIG. 1) through the opening 104 in the lid 100 without having to hold onto the container 28 itself. Such an arrangement facilitates one-handed retrieval of the towels 24 from the container 28. In particular, the teeth 108 on the lid 100 allow the user to abruptly yank or pull on the roll of disposable towels 24 with one hand to separate a single sheet from the roll. The bracket 32 secures the container 28 in place so that the container 28 is not pulled off of the support surface when the user pulls on the towels 24.

Figure 13:
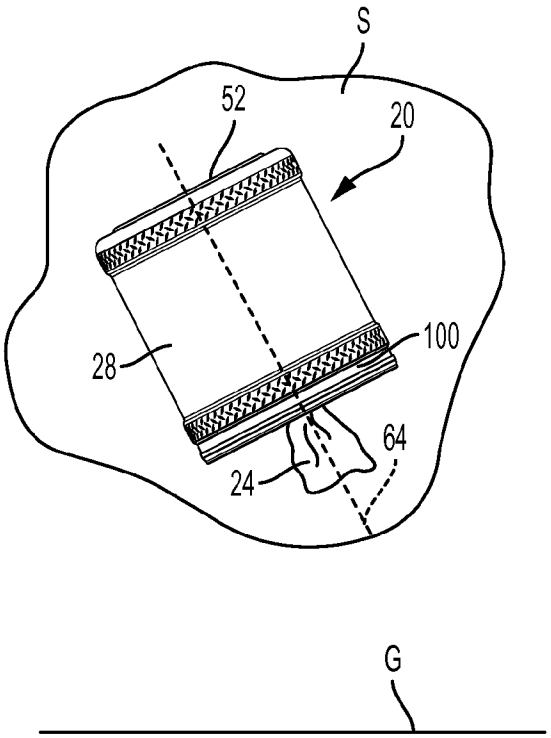
FIG. 13 illustrates the dispensing system in a third orientation.
Figure 12:
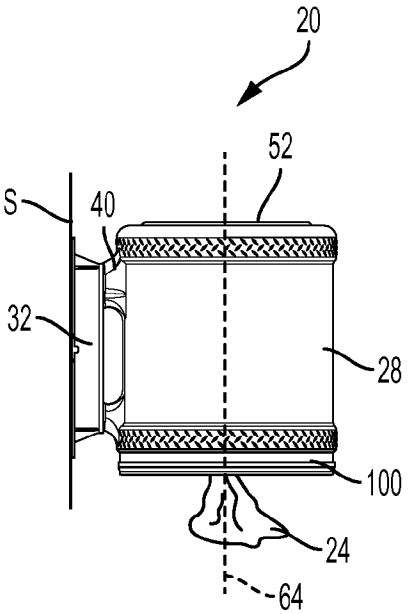
FIG. 12 illustrates the dispensing system in a second orientation.
Figure 11:
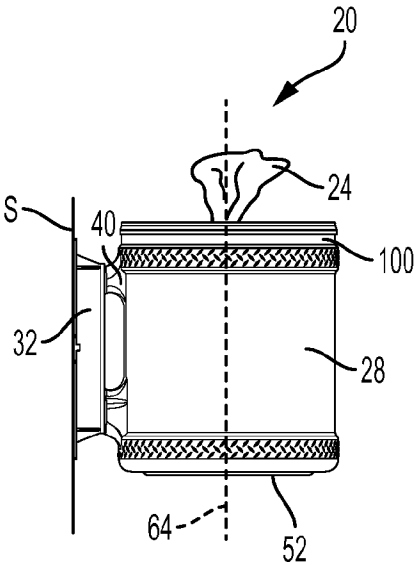
FIG. 11 illustrates the dispensing system in a first orientation.

FIGS. 11-13 illustrate various orientations of the dispensing system 20 relative to a support surface S (e.g., a wall) and the ground G (e.g., a floor). FIG. 11 illustrates the system 20 in an upright orientation. In this orientation, the bottom 52 of the container 28 faces the ground G, and the lid 100 of the container 28 faces away from the ground G. In addition, the central longitudinal axis 64 of the container 28 is generally perpendicular to the ground G. With such an arrangement, the opening 104 in the lid 100 generally faces away from the ground G so that the system 20 dispenses the disposable towels 24 upward (relative to gravity).

FIG. 12 illustrates the system 20 in an upside-down orientation. In this orientation, the lid 100 of the container 28 faces the ground G, and the bottom 52 of the container 28 faces away from the ground G. In addition, the central longitudinal axis 64 of the container 28 is generally perpendicular to the ground G. With such an arrangement, the opening 104 in the lid 100 generally faces toward the ground so that the system 20 dispenses the disposable towels 24 downward (relative to gravity). Compared to the upright orientation (FIG. 11), the upside-down orientation can be achieved by simply rotating the container 28 one-hundred-eighty degrees relative to the bracket 32 without having to change the orientation of the bracket 32 on the support surface S.

FIG. 13 illustrates the system 20 in an angled orientation. In this orientation, the central longitudinal axis 64 of the container 28 is oriented at an oblique angle relative to the ground G. The lid 10, however, generally faces the ground G so that the system 20 dispenses the disposable towels 24 generally downward. It should be readily understood that the bracket 32 can be mounted to the support surface S at a variety of angles to achieve any desired orientation relative to the ground G, as long as the closed end 144 of the bracket 32 is not higher than the open end 140 of the bracket 32. For example, in further embodiments, the bracket 32 can be mounted horizontally relative to the ground G so that the longitudinal axis 64 of the container 28 is parallel to the ground G.

In operation, the bracket 32 is first mounted to the support surface S in the desired orientation. As discussed above, the bracket 32 may be mounted to the support surface S using fasteners or the like. Once the bracket 32 is secured to the support surface S, the handle 40 of the container 28 is slid into the channel 136 of the bracket 32. As the handle 40 slides into the bracket 32, the rails 124 of the bracket 32 are received in the slots 96 of the handle 40. When the handle 40 is fully slid into the channel 136, the container 28 is suspended from the support surface S by the bracket 32. The disposable towels 24 can then be dispensed from the container 28 through the opening 104 in the lid 100 by pulling the towels 24 out of and away from the container 28.

Figure 14:
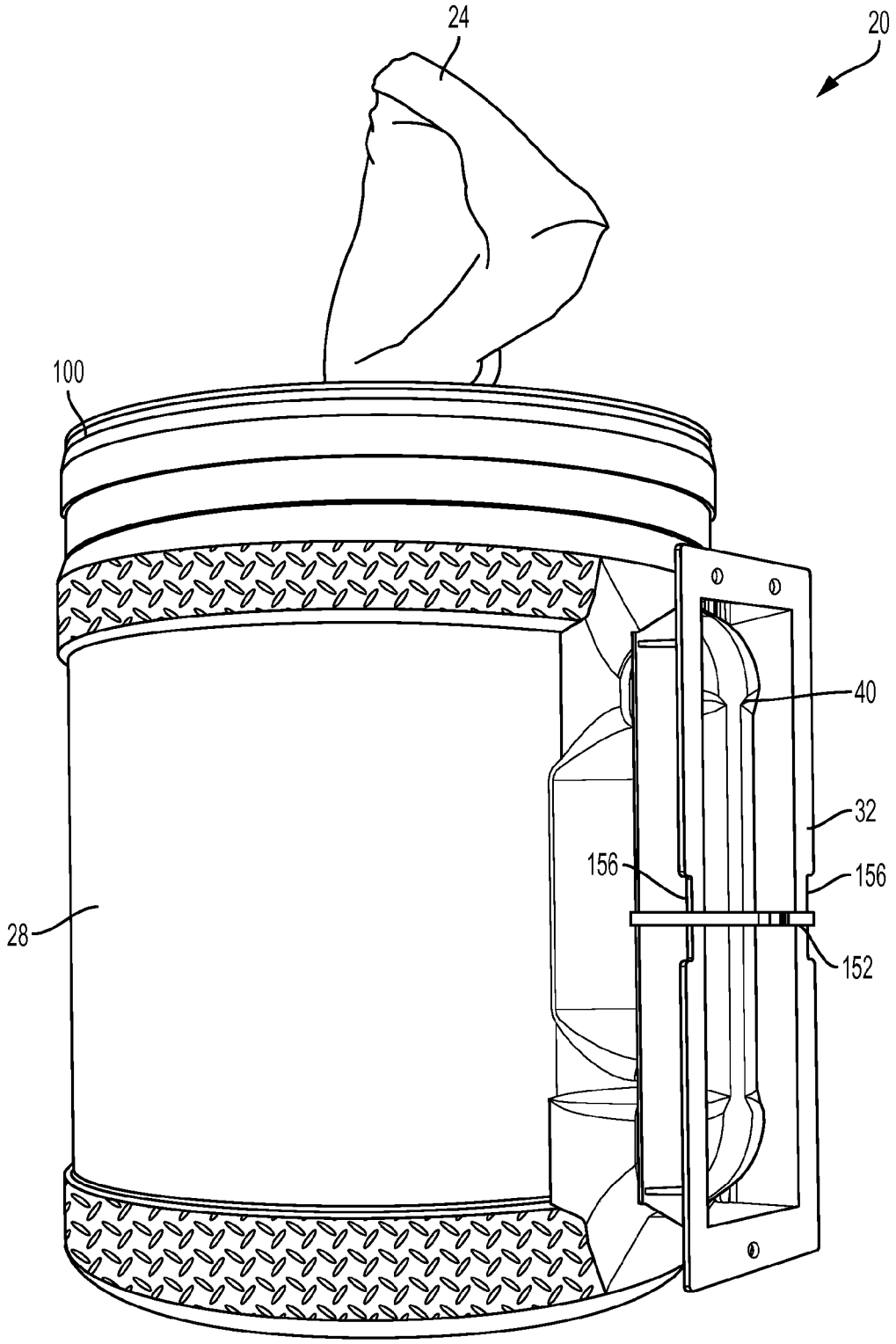
FIG. 14 is a perspective view of the dispensing system with the bracket secured to the container by a retainer.

FIG. 14 illustrates the dispensing system 20 with the bracket 32 secured to the container 28 by a retainer 152. The retainer 152 inhibits removal of the bracket 32 from the container 28. This arrangement is suitable at a retail or other point-of-sale location to keep the bracket 32 and the container 28 together. The illustrated retainer 152 wraps around the handle 40 of the container 28 and the bracket 32. In particular, the retainer 152 extends through the opening 92 formed between the handle 40 and the outer surface 60 of the container 28. The retainer 152 is also received in notches 156 formed along opposing outer edges of the baseplate 116 of the bracket 32. The notches 156 inhibit the retainer 152 from sliding along (e.g., up and down) the bracket 32. After the system 20 is purchased, the retainer 152 may be removed (e.g., cut off) by a user so the bracket 32 can be mounted to a wall and can removably receive the container 28. In the illustrated embodiment, the retainer 152 is a cable tie or zip tie. In other embodiments, the retainer 152 may be any other suitable elongate, flexible member (e.g., strap, cord, cable, string or twine, etc.) that can wrap around and secure the bracket 32 to the container 28.

During manufacture, the retainer 152 is coupled to the dispensing system 20 by a machine. The handle 40 of the container 28 and the bracket 32 are aligned within an opening between two jaws of the machine. The jaws are then closed and clamped around the bracket 32. The retainer 152 is delivered through a channel inside the jaws, feeding through one side and into the other side. The retainer 152 is then tightened to a desired tension by either the machine or manually. Excess length is cut off of the retainer 152, leaving no sharp edges.

Various features and advantages of the invention are set forth in the following claims.

What is claimed is:

1. A system for dispensing towels, the system comprising:

a container configured to receive the towels; and a bracket configured to mount to a support surface, the bracket engaging the container to alternately suspend the container from the support surface in a first orientation relative to the bracket and in a second orientation relative to the bracket that is different than the first orientation;

wherein the container includes a handle configured to be grasped by a user, and wherein the bracket engages the handle to suspend the container from the support surface.

2. The system of claim 1, wherein the container includes an opening through which the towels are dispensed, wherein the opening generally faces away from the ground when in the first orientation, and wherein the opening generally faces toward the ground when in the second orientation.

3. The system of claim 1, wherein one selected from the group consisting of the handle and the bracket defines a slot, wherein the other selected from the group consisting of the handle and the bracket includes a rail, and wherein the slot receives the rail to connect the container to the bracket.

4. The system of claim 3, wherein the slot is a first slot and the rail is a first rail, wherein the one selected from the group consisting of the handle and the bracket defines a second slot that is spaced apart from the first slot, wherein the other selected from the group consisting of the handle and the bracket includes a second rail that is spaced apart from the first rail, and wherein the second slot receives the second rail to connect the container to the bracket.

5. The system of claim 1, wherein the container also includes a body that is configured to receive the towels, and wherein the handle projects outwardly from the body.

6. The system of claim 5, wherein the bracket defines a channel, and wherein at least a portion of the handle is received in the channel.

7. The system of claim 6, wherein the bracket includes a baseplate, a sidewall, and a rail that define the channel, wherein the handle defines a slot, and wherein the slot receives the rail to connect the container to the bracket.

8. The system of claim 5, wherein the handle defines an opening between a grip of the handle and an outer surface of the body.

9. The system of claim 8, wherein the handle extends in a direction that is generally parallel to a central longitudinal axis of the body.

10. The system of claim 1, wherein the container includes a body and a lid, wherein the body is configured to receive the towels, and wherein the lid is connected to an open end of the body and has an opening through which the towels are dispensed.

11. The system of claim 10, wherein the lid includes a plurality of teeth extending into the opening, and wherein the plurality of teeth is configured to selectively engage the towels as the towels are dispensed.

12. A system for dispensing towels, the system comprising:

a container including a body configured to receive the towels, the body including an open end and a closed end, a handle projecting outwardly from the container, the handle configured to be grasped by a user, and a lid connected to the open end of the body, the lid having an opening through which the towels are dispensed; and a bracket configured to mount to a support surface, the bracket engaging the container to alternately suspend from the container from the support surface in a first orientation in which the opening of the lid generally faces toward the ground and in a second orientation in which the opening of the lid generally faces away from the ground, wherein the container is movable relative to the bracket to change between the first orientation and the second orientation;

wherein the container defines a slot, wherein the bracket includes a rail, wherein the slot receives the rail to connect the container to the bracket, and wherein the slot is formed in the handle.

13. The system of claim 12, wherein the bracket includes a generally planar baseplate, a first sidewall extending generally perpendicularly from the baseplate, a second sidewall spaced apart from the first sidewall and extending generally perpendicularly from the baseplate, a first rail formed on a free end of the first sidewall and extending generally toward the second sidewall, and a second rail formed on a free end of the second sidewall and extending generally toward the first sidewall, wherein the first and second rails engage the container to suspend the container from the support surface.

14. The system of claim 12, wherein the lid includes a plurality of teeth extending into the opening, and wherein the plurality of teeth is configured to selectively engage the towels as the towels are dispensed.

15. The system of claim 12, further comprising a retainer that secures the bracket to the container to inhibit removal of the bracket from the container.

16. The system of claim 15, wherein the bracket includes a notch, and wherein the retainer is received in the notch to inhibit movement of the retainer along the bracket.

17. A method of dispensing towels from a container, the container including a handle configured to be grasped by a user, the method comprising:

mounting a bracket to a support surface;

engaging the handle of the container with the bracket so that the bracket suspends the container from the support surface in a first orientation relative to the bracket;

dispensing the towels from the container while the container is suspended from the support surface by the bracket in the first orientation;

engaging the handle of the container with the bracket so that the bracket suspends the container from the support surface in a second orientation relative to the bracket that is different than the first orientation; and dispensing the towels from the container while the container is suspended from the support surface by the bracket in the second orientation.

18. The method of claim 17, further comprising moving the container between the first orientation and the second orientation without dismounting the bracket from the support surface.

19. The method of claim 17, wherein the container includes a body having an open end and a closed end, the handle projecting outwardly from the body, and a lid connected to the open end of the body and having an opening through which the towels are dispensed, and wherein engaging the handle of the container with the bracket so that the bracket suspends the container from the support surface in the second orientation includes engaging the handle of the container with the bracket so that the opening of the lid generally faces toward the ground.

* * * * *